US007334550B2

(12) United States Patent
Jesel et al.

(10) Patent No.: US 7,334,550 B2
(45) Date of Patent: Feb. 26, 2008

(54) VALVE TRAIN AND CAM LOBE

(75) Inventors: Daniel H. Jesel, Lakewood, NJ (US); Walter R. Donovan, Lakewood, NJ (US)

(73) Assignee: Jesel, Inc., Lakewood, NJ (US)

( * ) Notice: Subject to any disclaimer, the term of this patent is extended or adjusted under 35 U.S.C. 154(b) by 0 days.

(21) Appl. No.: 10/545,679

(22) PCT Filed: Feb. 17, 2004

(86) PCT No.: PCT/US2004/004521

§ 371 (c)(1),
(2), (4) Date: Sep. 28, 2006

(87) PCT Pub. No.: WO2004/074644

PCT Pub. Date: Sep. 2, 2004

(65) Prior Publication Data

US 2007/0017461 A1 Jan. 25, 2007

Related U.S. Application Data

(60) Provisional application No. 60/447,325, filed on Feb. 14, 2003.

(51) Int. Cl.
*F01L 1/04* (2006.01)

(52) U.S. Cl. ..... 123/90.6; 123/90.44; 29/888.1

(58) Field of Classification Search ..... 123/90.27, 123/90.44, 90.6; 29/888.1; 74/567, 569
See application file for complete search history.

(56) References Cited

U.S. PATENT DOCUMENTS

| | | | | |
|---|---|---|---|---|
| 5,309,872 | A | 5/1994 | Filippi | |
| 5,606,942 | A | 3/1997 | Tsuzuku et al. | |
| 5,647,310 | A * | 7/1997 | Kimura | 123/90.6 |
| 5,752,479 | A | 5/1998 | Kinoshita | |
| 6,550,437 | B2 | 4/2003 | Nakamura | |

* cited by examiner

*Primary Examiner*—Ching Chang
(74) *Attorney, Agent, or Firm*—Timothy J. Klima

(57) ABSTRACT

A camshaft for an internal combustion engine includes a cam lobe for actuating a valve. The cam lobe has an opening ramp profile that acts to loft the valve gear away from contact with the cam lobe to a maximum lift of the valve, with the valve gear returning to contact with a closing ramp of the cam lobe sufficiently in advance of a minimum cam lobe closing ramp height so as to dissipate enough closing energy of the valve to minimize valve bounce after the valve contacts a corresponding valve seat.

25 Claims, 9 Drawing Sheets

SOLID LINE
PRESCRIBED MOTION

DASHED LINE
ACTUAL MOTION (CURRENT INVENTION)
1
2
6
FIG. 3a.1
FIG. 3b.1
TIME
TIME
3
4
VELOCITY
mpv
12
5
nv
nv
pv
pv
mnv
13
FIG. 3a.2
FIG. 3b.2
ACCELERATION
10
7
11
9
8
FIG. 3a.3
FIG. 3b.3

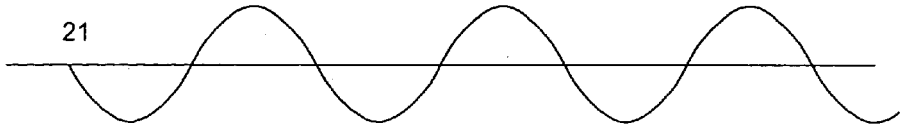
FIG. 4a.1
SPRING OSCILLATION
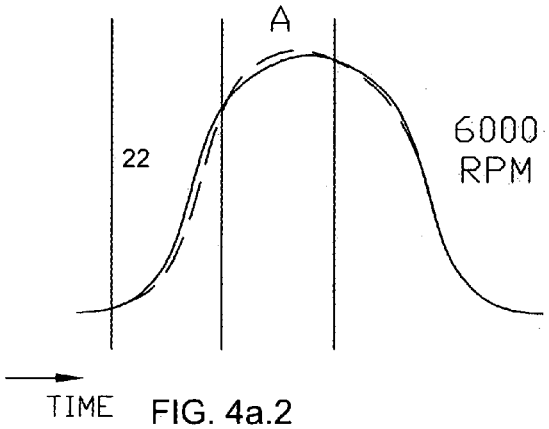
FIG. 4a.2
(Prior Art)
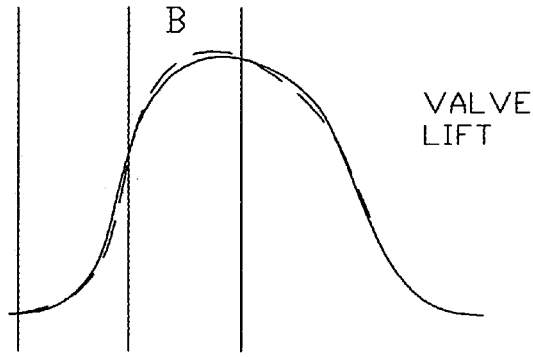
FIG. 4a.3
(Current Invention)
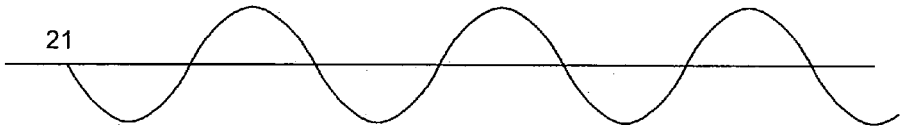
FIG. 4b.1
SPRING OSCILLATION
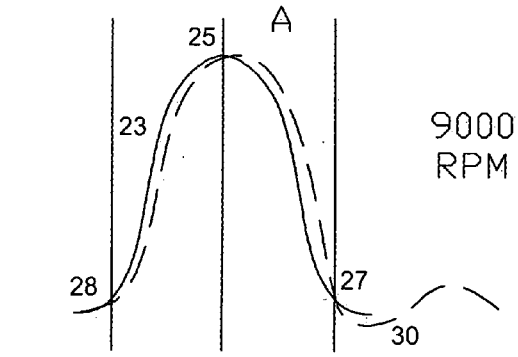
FIG. 4b.2
(Prior Art)
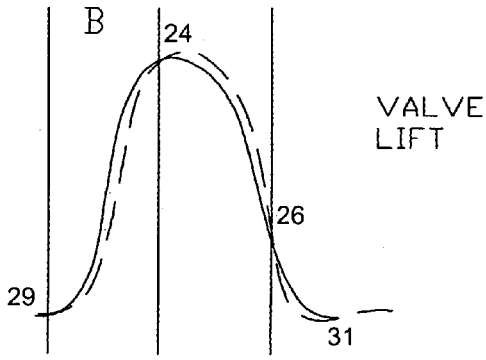
FIG. 4b.3
(Current Invention)

Lift Comparison (at Valve)

Velocity Comparison (at Valve)

Accel Comparison (at Valve)

VALVE TRAIN AND CAM LOBE

This application is the national phase of international application PCT/US04/04521 filed Feb. 17, 2004 which designated the U.S. and that international application was published under PCT Article 21(2) in English. This application claims priority to U.S. Patent application No. 60/447,325, filed Feb. 14, 2003, which is incorporated by reference herein.

BACKGROUND

This invention relates to internal combustion valvetrains, and similar mechanisms, and, in particular, to a cam lobe shape used in such valve trains.

Partially due to resonant frequencies and component inertias, high-speed spring-biased camshaft systems, such as the valve train of an internal combustion engine, all have a limiting speed where the excitation frequency exceeds the reaction frequency of the return spring. The excitation frequency of a high-speed engine valvetrain is determined by camshaft lobe shape characteristics and operating speed. The reaction frequency is determined by the system inertia, return spring force and natural frequencies of the spring and components. Attempts at raising the engine limit speed currently involve: 1) lowering the system inertia by using parts with lower mass and 2) increasing the return spring pressure. Either method is beneficial however current racing trends have dictated that both methods be exploited to their fullest extent, leaving no more limit speed gains possible through these common industry practices. Another industry trend in the pursuit of higher power per RPM is to quicken the opening ramp of the camshaft lobe because it has been proven that this increases power. This practice is severely limited by the necessity of performing the above methods 1 & 2 to an even further extent.

Through the speed range, a spring-biased valve train normally undergoes three modes of operation. At low to medium RPMs, the system is in controlled mode. The return spring is adequate to keep the components in contact with each other, transmitting the prescribed cam motion through the system to the valve. Approaching the limit speed, it enters the loft mode when the return spring cannot keep the components in contact with each other. In FIG. 1 (and FIGS. 2 and 4), the prescribed motion (the motion prescribed by the cam lobe) is indicated as a solid line and the actual motion of the valve is indicated as a dashed line. The valve train is compressed at 51 from acceleration of the camshaft lobe against the resistance of inertia of the components, lofted at 52, causing gaps between the components so that their motion no longer follows that prescribed by the camshaft, and collides one or more times at 53 at a period prescribed by the natural frequencies of the spring and other system parts.

As the RPMs increase further, the bounce mode is reached where the closing valve imparts collision energy into the cylinder head and this energy reacts to bounce the valve off the valve seat. The spring and component oscillation frequencies have remained constant, but because the camshaft is spinning faster, the cam lobe frequency has increased. This causes the collision of parts to occur later relative to the cam lobe. See FIG. 2. The collision at 53 has occurred so close to the bottom of the closing ramp that the energy cannot be absorbed entirely by the valve train and is transmitted to the interface of the valve and valve seat. At point 54, an elastic reaction from the collision is begining that acts to bounce the valve off the seat at 55. The loss of sealing in this mode can reduce volumetric efficiency of the engine and the increased vibrational frequencies created can often break valve springs.

BRIEF SUMMARY OF THE INVENTION

The present invention is a camshaft for an internal combustion engine that includes a cam lobe for actuating a valve. The cam lobe has an opening ramp profile that acts to loft the valve gear away from contact with the cam lobe to a maximum lift of the valve, with the valve gear returning to contact with a closing ramp of the cam lobe sufficiently in advance of a minimum cam lobe closing ramp height so as to dissipate enough closing energy of the valve to minimize valve bounce after the valve contacts a corresponding valve seat.

It is an object of the present invention to overcome the problems with the prior art discussed above.

It is a further object of the present invention to minimize valve bounce after the valve contacts a valve seat.

It is a further object of the present invention to increase the RPM limit of an engine by minimizing valve bounce.

These and other features and objects of the present invention will be apparent from the description below.

BRIEF DESCRIPTION OF THE DRAWINGS

FIGS. 4*a*.1-4*b*.3 are graphs comparing valve lift at approximately 6000 RPM for a conventional cam lobe with valve lift for a cam lobe of the present invention;

FIGS. 4*b*.1-4*b*.3 are graphs comparing valve lift at approximately 9000 RPM for a conventional cam lobe with valve lift for a cam lobe of the present invention;

DETAILED DESCRIPTION OF THE INVENTION

The present invention is a camshaft for a high-speed spring-biased camshaft system, for example, for use in an internal combustion engine, that includes a cam lobe for actuating a valve. The cam lobe has an opening ramp profile that acts to loft the valve gear away from contact with the cam lobe to a maximum lift of the valve, with the valve gear retuning to contact with a closing ramp of the cam lobe sufficiently in advance of a minimum cam lobe closing ramp height so as to dissipate enough closing energy of the valve to minimize valve bounce after the valve contacts a corresponding valve seat.

Figure 1:
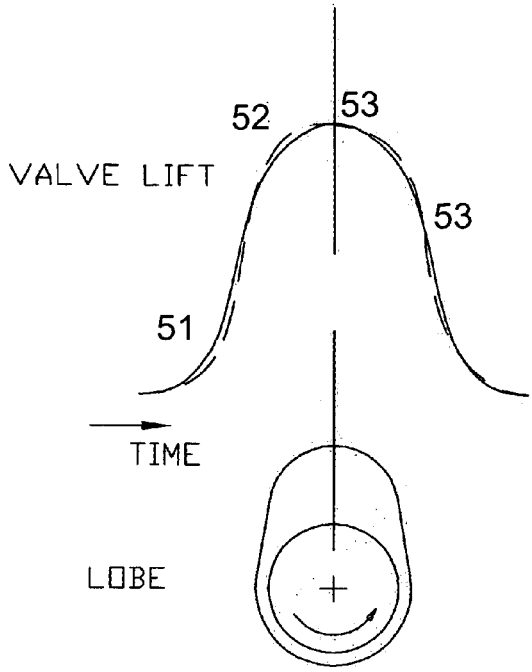
FIG. 1 (PRIOR ART)
FIG. 1 (Prior Art) is a graph showing valve lift in comparison to position on a cam lobe for a conventional cam lobe.
Figure 2:
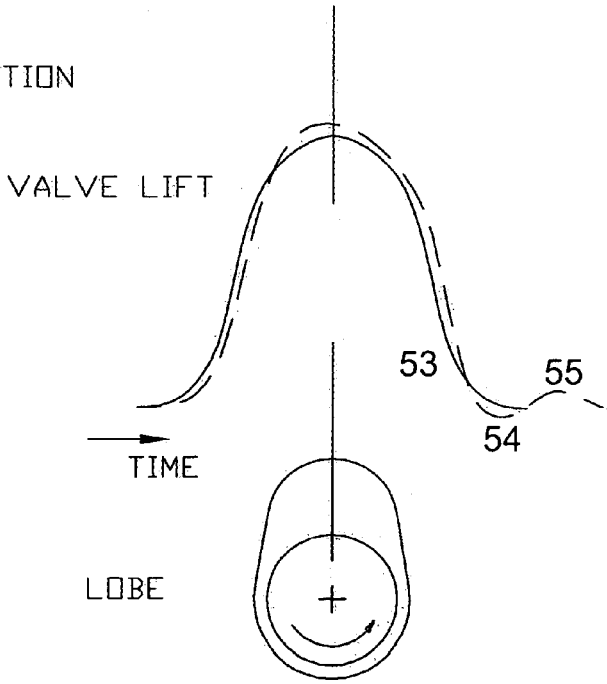
FIG. 2 (PRIOR ART)
FIG. 2 (Prior Art) is a graph showing valve lift in comparison to position on a cam lobe for a conventional cam lobe at a higher RPM than in FIG. 1.
Figures 3A, 3B:
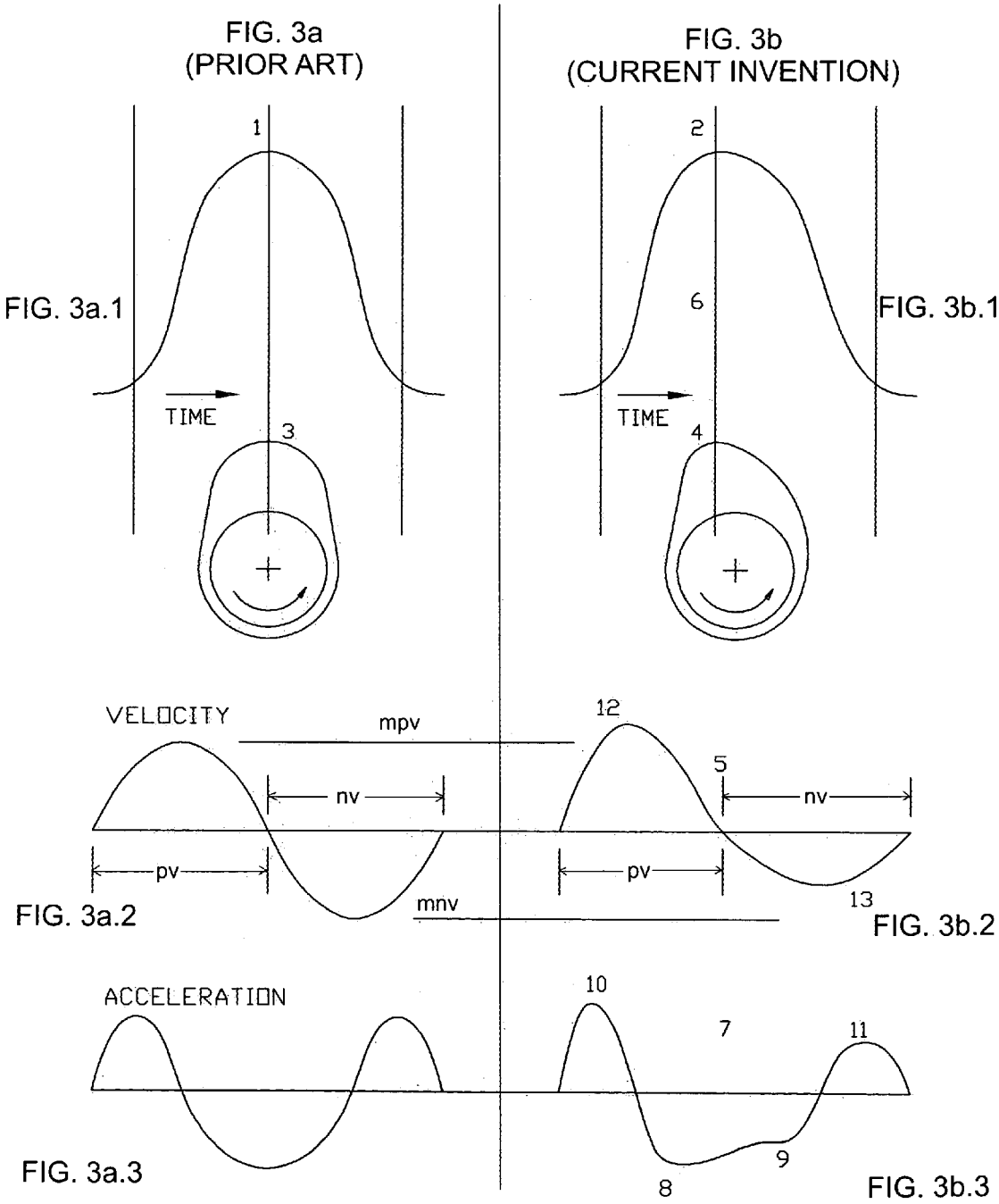
FIG. 3a (PRIOR ART)
FIG. 3*a* (including FIGS. 3*a*.1-3*a*.3) (Prior Art) is a graph showing valve lift, cam lobe ramp velocity and cam lobe ramp acceleration in comparison to position on a cam lobe for a conventional cam lobe.
FIG. 3*b* (including FIGS. 3*b*.1-3*b*.3) is a graph showing valve lift, cam lobe ramp velocity and cam lobe ramp acceleration in comparison to position on a cam lobe for a cam lobe according to the present invention.

The invention includes a set of lobe shape characteristics that extends both RPM and power-per-RPM limits by the use of specific methods, or "tools" for the purpose of simplification. It is characterized by, but not limited to, one or more of the following:

1. Maximum Lift Advance:

Maximum lift of the valve (LMax), see FIG. 3*a*.1, reference numeral 1, is normally found at or near the center of the main event, with the main event being defined as the part of the cam profile above the ramps, that is, the major portion of the lift curve not counting the extreme ends of the motion curve which can often include asymmetrical lash ramps and other features. The maximum lift LMax with a conventional cam lobe is not necessarily at the center of the total event, with the total event being defined as the entire cam lobe above base circle. The attached figures are not to scale.

In the present invention, LMax is advance shifted toward the cam lobe open ramp. See FIG. 3*b*.1, reference numeral 2. The current invention utilizes a minimum shift (advance) of about 3 camshaft degrees (3° camshaft, equals 6° crankshaft). Maximum shift is not determined by optimum operating conditions but rather by practical mechanical limits imposed by current valve spring technology. Designs employing a 6° camshaft (12° crankshaft) shift have been employed and found successful but this is not necessarily optimal for all implementations and the invention is not limited to such a shift. Other advance shifts within the range of 3-12° camshaft, or more, can be used. The maximum lift at the cam lobe is shown as reference numerals 3 and 4 in FIGS. 3*a*.1 and 3*b*.1, respectively.

2. Shortened positive velocity/lengthened negative velocity periods:

The present invention uses a substantially shorter positive velocity (opening ramp) period of the cam lobe and a substantially longer negative velocity (closing ramp) period, as compared to a conventional cam lobe. Compare the conventional cam lobe velocity graph shown in FIG. 3*a*.2 with the present invention cam lobe velocity graph of FIG. 3*b*.2. With the conventional cam lobe the duration (period) of the positive velocity (pv) is roughly equal to the duration of the negative velocity (nv). In the present invention, the positive velocity period (pv) is shortened and the negative velocity period (nv) is lengthened such the crossover point 5 is advanced. See FIG. 3*b*.2. In the present invention, a minimum advance shift of about 3° camshaft (6° crankshaft) of the crossover point is used, corresponding to the 3° camshaft shift of the LMax discussed in item 1 above. This results in a pv period being shorter than the nv period in the present invention by a minimum of about 6° camshaft (12° crankshaft). Crossover point 5 in FIG. 3*b*.2 is also shown as crossover point 6 in FIG. 3*b*.1, corresponding to the LMax at point 2.

3. Absolute value of opening ramp (positive) velocity greater than absolute value of closing ramp (negative) velocity.

With a conventional cam lobe, as shown in FIG. 3*a*.2, the maximum absolute value for opening ramp (positive) velocity is approximately the same as the maximum absolute value for closing ramp (negative) velocity. Compare the absolute values marked by the lines designated mpv (maximum positive velocity) and mnv (maximum negative velocity). In the present invention, the maximum absolute value for opening ramp (positive) velocity is greater than the maximum absolute value for closing ramp (negative) velocity. See FIG. 3*b*.2. Thus, as shown, the maximum absolute value for opening ramp velocity 12 is greater than the maximum absolute value for closing ramp velocity 13.

4. Minimum cam lobe acceleration before maximum valve lift:

With a conventional cam lobe, the minimum acceleration is at or near the center of the main event, which generally is at maximum lift, as discussed above. See FIG. 3*a*.3. In the present invention, see FIG. 3*b*.3, the minimum acceleration 8 is before maximum lift 7. Therefore, the minimum acceleration must be advance shifted by an amount greater than the shift of the maximum valve lift LMax. This is not less than about 3° camshaft before the center of the main event, as discussed above. The maximum amount of advance shift shares the same restrictions as the shift of maximum lift.

5. Peak positive opening ramp acceleration higher than peak positive closing ramp acceleration.

With the conventional cam lobe, see FIG. 3*a*.3, the peak positive opening ramp acceleration is generally equal to the peak positive closing ramp acceleration. In the present invention, see FIG. 3*b*.3, the peak positive opening ramp acceleration 10 is greater than the peak positive closing ramp acceleration 11.

6. Any other lobe shape characteristics (dips, flats, modified acceleration or velocity curves, or others) generated with the purpose of achieving the effects outlined herein.

7. Any method of mimicking the complex motion of a cam lobe or modifying cam lobe motion to otherwise produce the motion characteristics at the valve as described herein, including but not limited to: levers, linkages, mechanical, fluid, or electrical actuators, dashpots, or software.

An embodiment of the present invention may use one or more of the above-discussed characteristics. An embodiment need not use all of the characteristics.

The effects produced by fabricating a lobe using this one or more of these cam lobe shape characteristics are as follows.

The invention raises limit speed RPM (the onset of valve bounce) allowing higher engine speeds by modifying the lobe frequencies. Limit speed is largely governed by spring and component natural frequencies, which remain constant as RPMs increase. FIGS. 4*a*.1 and 4*b*.1 show a fixed spring oscillation period wave regardless of RPM. Compare reference numeral 21 in FIG. 4*a*.1 with reference numeral 28 in FIG. 4*b*.1. However, cam lobe frequencies increase with higher RPMs. Compare reference numeral 23 in FIG. 4*b*.2 with reference numeral 22 in FIG. 4*a*.2, which shows a decreasing wave period, i.e., a higher frequency, of the cam lobe at the higher RPM shown in FIG. 4*b*.2.

System wide, this effect produces a relative frequency that increases with speed. The term "relative frequency" is used to describe the lobe frequencies in relation to the natural spring and component frequencies. To treat the entire system as a single entity, relative values such as velocity and acceleration are far more important than absolute values. This is one basis for the entire invention. Higher spring frequencies generally allow higher RPM limits, but because spring frequency is constant, it cannot be raised as the RPM increases. The invention produces a lower net frequency lobe so relative frequency is also lowered. The effect is the same as raising the spring frequency. Locally, the invention raises the opening frequency and lowers the closing frequency but the net effect is to lower the relative frequency of the portion of the total event starting with lash take-up and continuing to the collision point (reference numeral 26 in FIG. 4*b*.3 and reference numeral 27 in FIG. 4*b*.2).

It should be noted that this effect is produced without stretching the overall event (or lowering the total event frequency), which is commonly known to be undesirable because it would change the operating characteristics of the engine from its intent.

The invention initiates loft early during the total event because it raises the relative frequency of the compression region by decreasing its period. This shorter period and resultant higher frequency is graphically shown in FIG. 4. Compare the distance in the current invention between points 29 and 24 in FIG. 4*b*.3 to the distance in the prior art between points 28 and 25 in FIG. 4*b*.2. Points 28 and 29 represent the beginnings of the total events and are determined by the shape of the lobe while points 25 and 24 indicate the crossovers from compression to loft and are determined predominantly by the natural frequency of the spring. It can be seen that this period is somewhat shorter in the present invention than that of the prior art. This effect in itself will also help force the collision earlier due to the spring reaction occurring at a fixed rate (reference 21 in FIG. 4*b*.1).

In a similar but opposite manner the invention then lengthens the period of the closing ramp, extending the lobe rearward toward the collision point at reference 26 in FIG. 4*b*.3. This longer period and resultant lower frequency is graphically shown in FIG. 4. Compare the distance in the present invention between points 31 and 24 in FIG. 4*b*.3 to the distance in the prior art between points 30 and 25 in FIG. 4*b*.2. Points 30 and 31 represent the ends of the total events and are determined by the shape of the lobe while points 25 and 24 indicate the crossovers from compression to loft and are determined predominantly by the natural frequency of the spring. It can be seen that this period is somewhat longer in the current invention than that of prior art. The collision point 26 in FIG. 4*b*.3 is also shifted left relative to the total event when compared to point 27 in FIG. 4*b*.2. The significance of this will be explained below as these two features combine to produce one net result.

The invention also raises portions of the closing ramp to help accomplish two things. Raising the closing ramp reduces the physical distance between actual and prescribed motion late in the event. In FIG. 4*b*.3, the prescribed motion is shown by the solid line while actual motion is indicated by the dashed line. The distance between these lines is shown to be less in FIG. 4*b*.3 just left of point 26 while it is significantly more in the prior art shown in FIG. 4*b*.2 just left of point 27. Raising the closing ramp has the additional effect of causing the collision higher up the ramp where, while prescribed and actual velocities are higher, they are lower relative to each other. Compare the convergence of actual to prescribed motions (dashed to solid) in FIG. 4*b*.3 to FIG. 4*b*.2. Note that the angle of convergence is significantly less in the current invention. This angle represents collision velocity. An analogy can be made that the current invention produces a collision that is comparable to glancing off a guardrail with an automobile while the prior art is more like hitting the guardrail straight on. Similarly, an analogy can be made to a ski jumper landing on an inclined slope (ski ramp) to dissipate energy before the skier arrives at level ground.

These three modifications of the collision are: 1) shifting the collision point to the left relative to the main event, 2) reducing the physical distance between actual and prescribed motion, and 3) reducing the convergence angle (velocity) between actual and prescribed motion. The net results are decreased collision energy being from lowered relative velocity and increased time for the camshaft (and entire valvetrain) to absorb this collision energy before the valve hits the seat. Therefore, there is less energy to be absorbed by the seating event. The combination of less energy and more time for damping allows higher engine RPM by delaying valve bounce to a higher RPM. All outlined characteristics of the present invention can contribute to this end.

Figure 5:
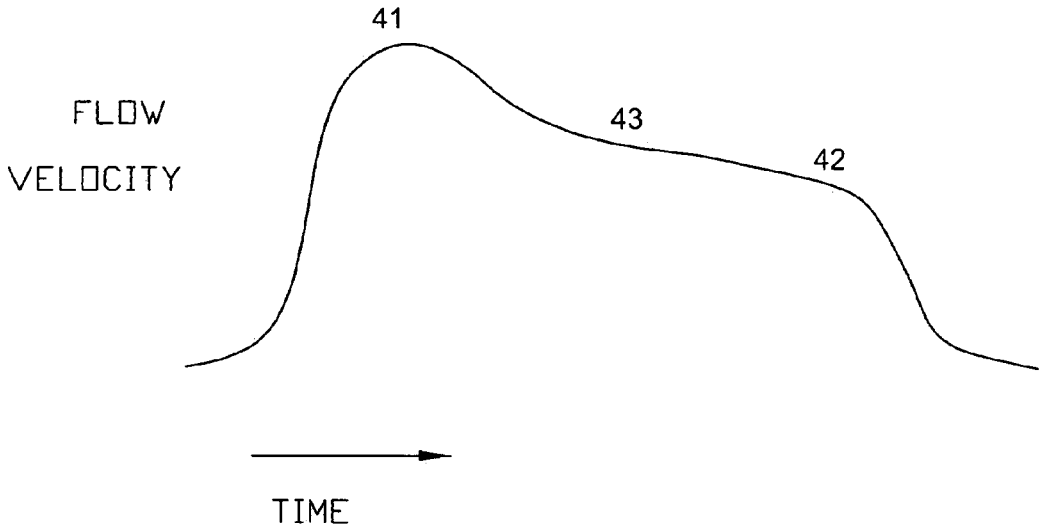
FIG. 5 is a graph showing flow velocity through a valve port.

The invention also provides higher power-per-RPM potential by addressing the relationship between the instantaneous valve lift and the typical flow velocity curves developed in the ports at the valves. See FIG. 5. This velocity is generated by a pressure drop across the valve. When the valve opens the pressure drop is greatest and the highest flow occurs at 41. As the pressure drop decreases, flow decreases at 42. A prior art cam lobe shape puts the highest valve lift at position 43 in the curve, long after highest flow and pressure drop is developed. The present invention moves the highest valve lift point forward toward point 41. This can translate into higher maximum flow velocity, total flow volume, and the power benefits that accompany it.

Description of Actual Models and Their Test Results

An implementation concentrated on for experimentation purposes is the valvetrain in a high-speed internal combustion engine. This implementation has been chosen for experimentation because it lends itself to changing motion characteristics by simply altering the shape of a camshaft lobe. Most of the examples and descriptions herein are based on the high-speed internal combustion engine valvetrain for this reason. The current invention is not limited to this implementation and further examples of possible implementations of the current invention will be given elsewhere in this patent application. In the case of the high-speed valvetrain (which is only a specific implementation of the current invention), only the shape of the motion of the valve itself is of concern. All efforts to make a specific shaped camshaft lobe, or other specific parts of the valvetrain, are incidental and only exist to contribute to the ultimate motion of the valve.

Figure 6:
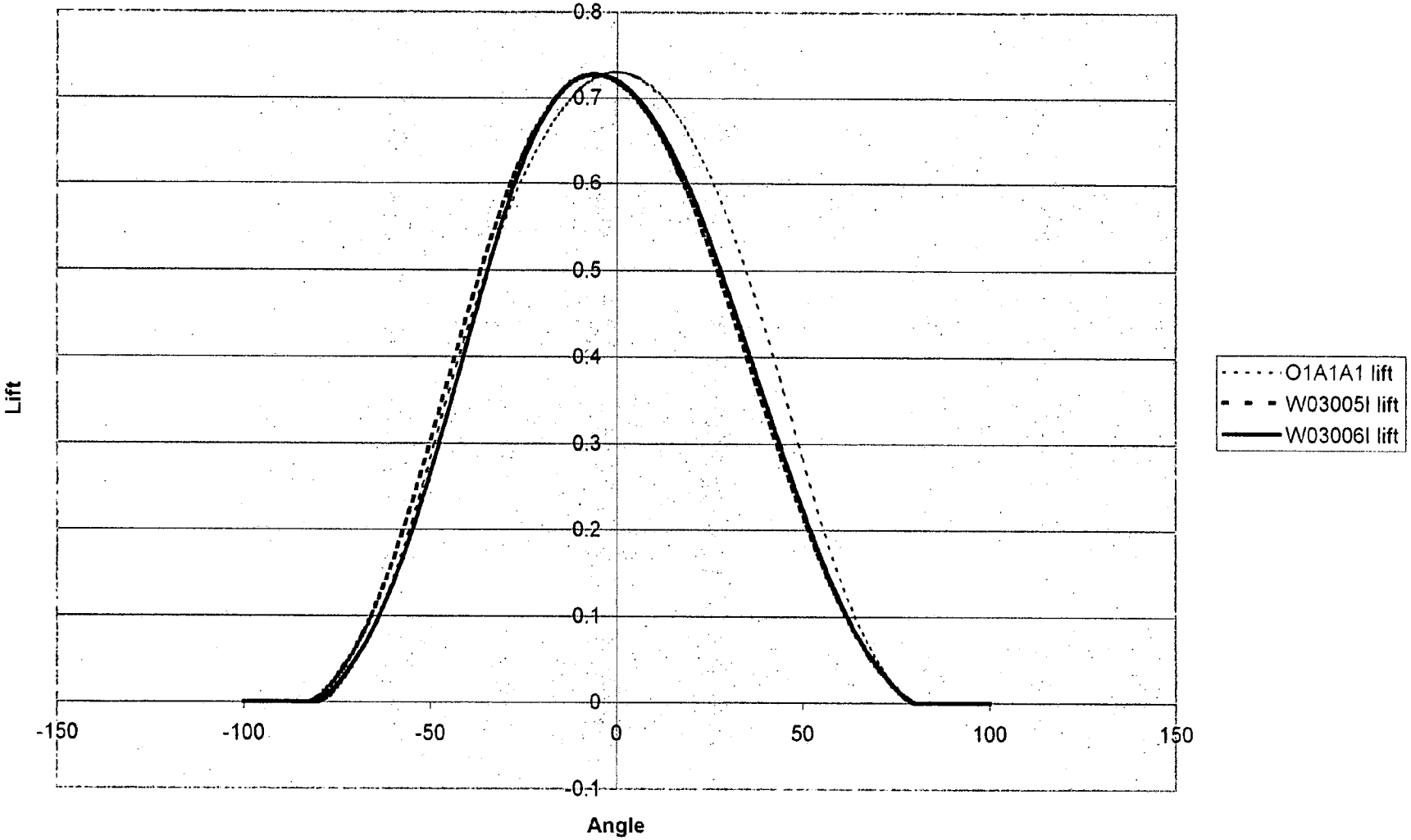
FIG. 6 is a graph comparing valve lift with a conventional cam lobe versus two embodiments of a cam lobe of the present invention.
Figure 7:
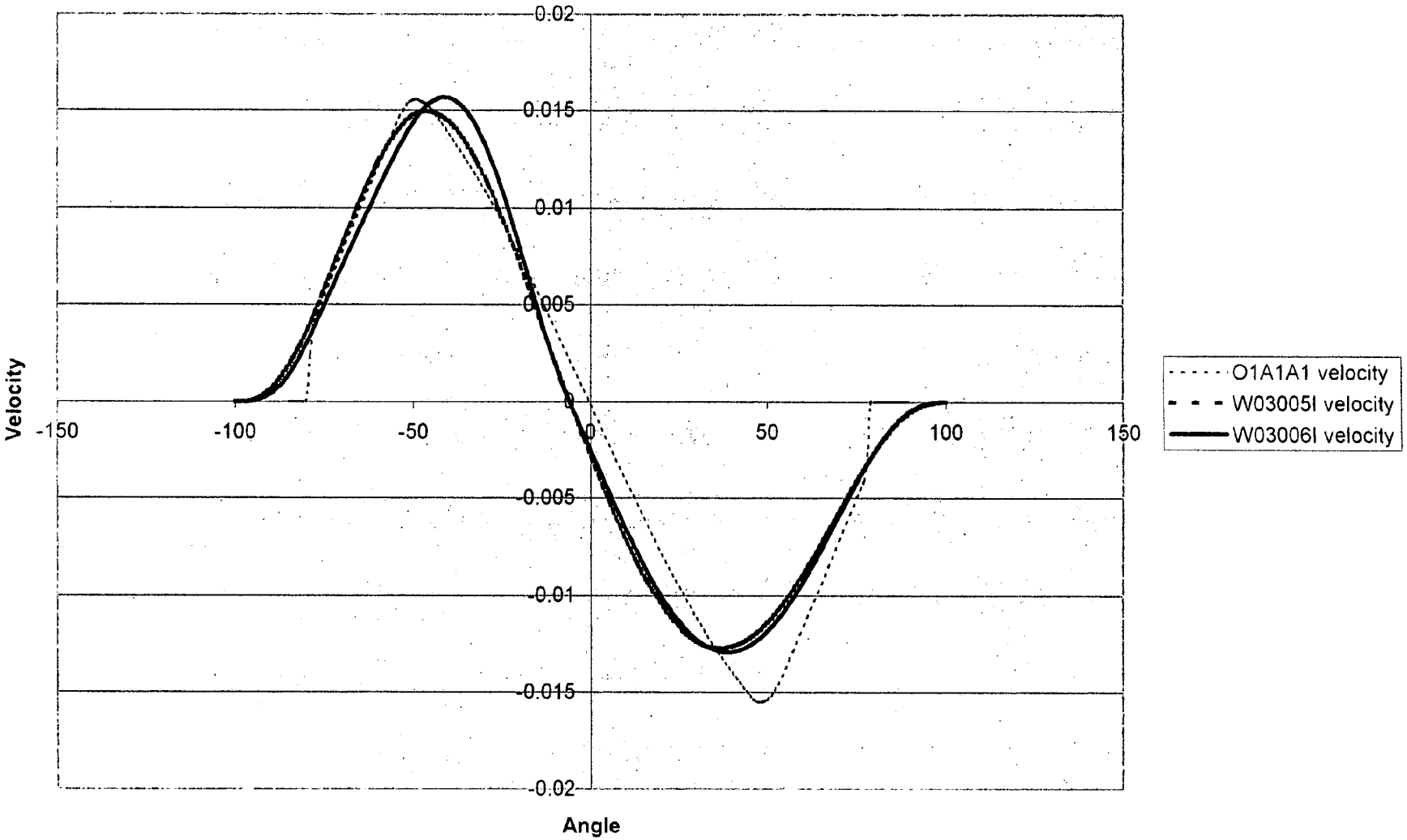
FIG. 7 is a graph comparing valve velocity with a conventional cam lobe versus two embodiments of a cam lobe of the present invention.
Figure 8:
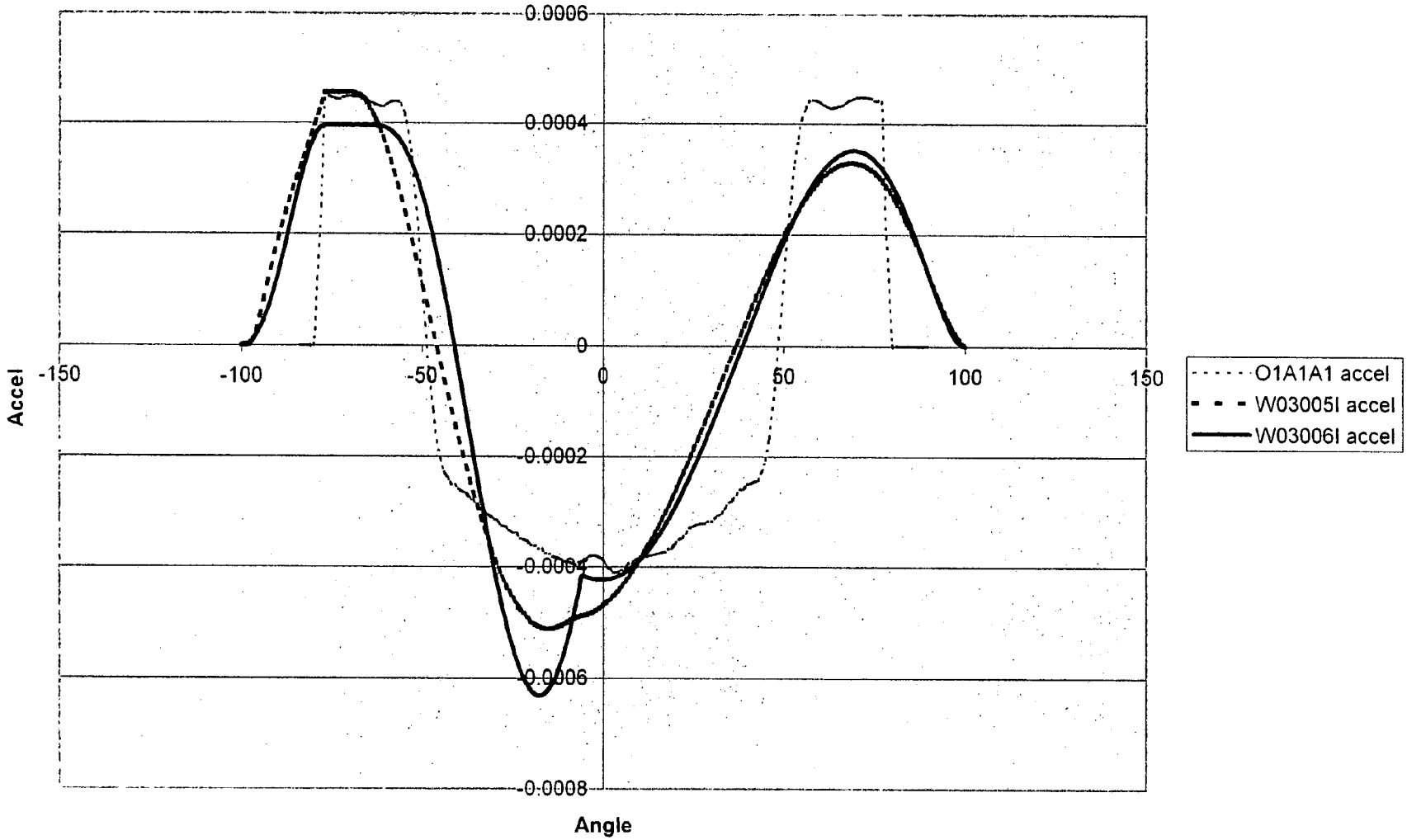
FIG. 8 is a graph comparing valve acceleration with a conventional cam lobe versus two embodiments of a cam lobe of the present invention.

Cam lobes have been produced employing the current invention and tested. The lobes were fabricated to produce specific valve motions, as shown in FIGS. 6, 7 & 8. The two lobe embodiments employing the current invention are designated in these three figures as W03005I and W03006I. A conventional lobe, designated O1A1A, is included in FIGS. 6-8 for comparison with the inventive cam lobes.

FIG. 6 is a graph of the lift motions of the valve. The maximum lift position of the prior art lobe O1A1A is approximately centered left to right across the entire lobe shape. This is typical of prior art cam lobes in that they exhibit symmetry in this respect within less than about 2-3° camshaft of center of the main event. In the example shown, the main event is between approximately plus and minus 70° camshaft. The lobes embodying the current invention, designated W03005I and W03006I both show a bias where maximum lift is shifted toward the opening ramp (toward the left), thus shortening the opening ramp and at the same time lengthening the closing ramp. This particular amount of shift is about 6° camshaft, although other amounts may be optimal for different implementations, up to about 9°, 12°, 18° camshaft, or possibly more in certain circumstances. It is intended that the invention encompass any range within the range of about 3-18° camshaft or greater.

This shifting of the maximum lift position is one tool in this set of improved lobe shape characteristics to increase relative frequency of the opening ramp and decrease relative frequency of the closing ramp by shortening and lengthening their durations respectively.

FIG. 7 is a graph of respective velocities of the same three lobe shapes. It can be seen that, while lobe O1A1A changes from positive to negative velocity at a point that is approximately centered left to right in the entire lobe shape (at 0°), this is not the case with lobes W03005I and W03006I. They clearly change from positive to negative velocities before the midpoint of the main event. Specifically, they cross the zero line at about 6° camshaft toward the opening ramp, although other amounts may be optimal for different implementations, up to about 9°, 12°, 18° camshaft, or possibly more in certain circumstances. It is intended that the invention encompass any range within the range of about 3-18° camshaft or greater.

Another tool shown in this graph is the vertical asymmetry of the velocities produced by W03005I and W03006I. They exhibit absolute positive values that are clearly higher than the absolute negative values of the closing ramp. The absolute opening ramp values are about 20% higher than the absolute closing ramp values, although testing has not shown yet whether this is optimum for any particular implementation. It is contemplated that the optimal figure, depending on the particular engine application, will fall between 10-40% higher or more, and any range therein. In contrast, the prior art O1A1A design shows a substantially symmetrical velocity curve. This vertical asymmetry is a tool in this set of improved lobe shape characteristics that can help both force the loft portion of the motion to occur early with the high velocity opening ramp and decrease the relative velocity during the closing ramp allowing the valve train to catch up and rejoin the camshaft.

FIG. 8 is a graph of accelerations caused by the valve motions of these three lobe shapes. Again, the acceleration produced by the O1A1A lobe is substantially symmetrical other than manufacturing and measurement errors. The W03005I and W03006I lobes show asymmetry in three distinct ways. Like the lift and velocity curves, the center of the negative acceleration area is shifted to the left of the center of the main event. Unlike the lift and velocity graphs, the lowest point is not at the maximum lift point. In one embodiment of the present invention, the minimum acceleration point must be before the maximum lift point, though this is not required in all embodiments. In the cases of the W03005I and W03006I lobes, this point is about 9° and 12° additional degrees before the maximum lift point, respectively. It is intended that the invention encompass any range within the range of about 3-21° camshaft or greater.

Other amounts may be optimal for different implementations. This shift is a tool in this set of improved lobe shape characteristics that performs the following: Since acceleration and the local radius of any point of the lobe are interrelated, the effect can be thought of as introducing a small radius at a control point that will intentionally make the cam lobe surface "steer away" from the rest of the valve train. This, in turn, helps initiate the loft described above.

The second asymmetry shown in FIG. 8 is that of the negative acceleration portion left to right. Negative acceleration values must be lower in the opening ramp than the closing ramp. It is expected that this will be in a range of 5-40% or more and any range therein, including a range of 10-20%. This helps initiate loft early and also prevents the cam lobe from "steering away" from the valve train too quickly to help catch it later. The net effect of the more gentle acceleration in the closing ramp is to help provide a more gentle collision later on, as described above.

The third and final asymmetry seen in the acceleration curves are that of the positive accelerations, opening ramp vs. closing ramp. It is expected that this will be in a range of 5-40% or more and any range therein, including a range of 10-20%. This helps initiate loft early by inducing an extra "shove" on opening and more gently catching the lofted valve train on closing, as described above.

In another approach to looking at the invention, the spot 26 where the valve gear returns to contact with the cam lobe after lofting will be approximately 10-40% above the minimum cam lobe height, or more, and any range therein, including a range of 10-20%, so that a substantial portion of the bounce energy in the valve gear has dissipated prior to the valve gear contacting the achieving the minimum cam lobe height.

These lobes were tested against successful camshaft designs currently used in the racing industry. Testing was done in a standard industry method employing a Spintron test rig to rotate the engine and laser measuring device to quantify valve bounce at various RPMs. Below are the results of 4 typical tests. Results are graphically shown in FIGS. 9 & 10.

Figure 9:
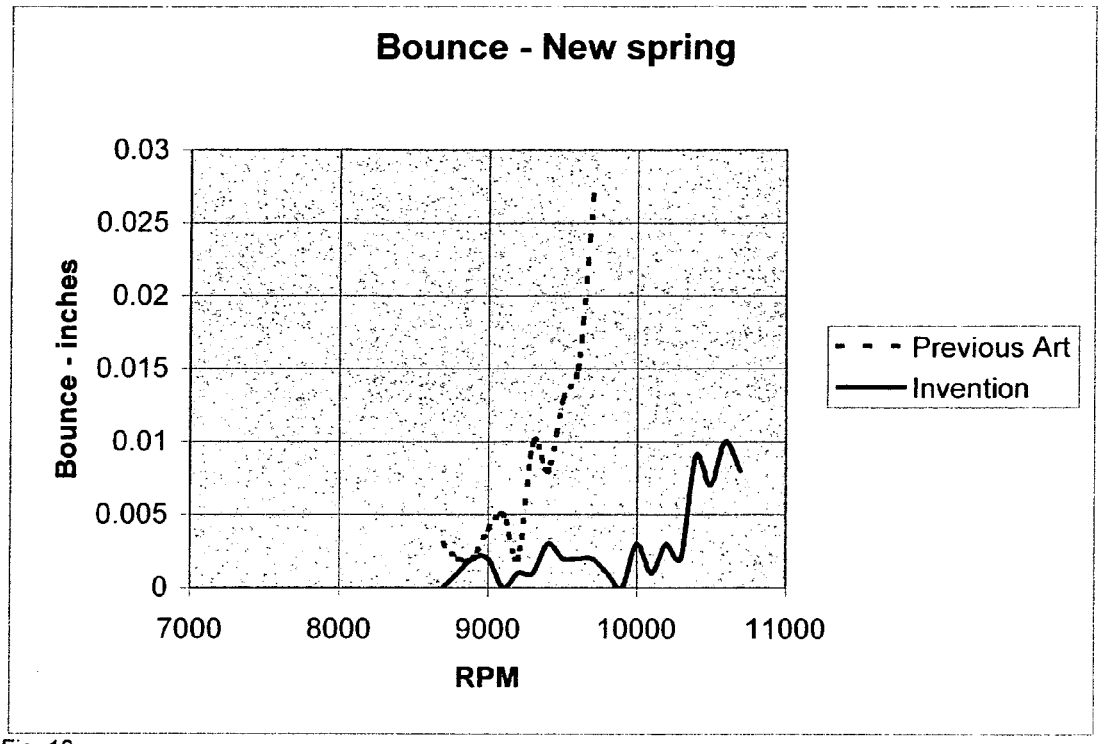
FIG. 9 is a graph comparing bounce of a new valve spring with a conventional cam lobe versus a cam lobe of the present invention.

FIG. 9 shows two tests superimposed whereas a new valve spring was installed at a seat pressure of 320 lb. This is typical of new spring pressures for this engine application. The dashed line indicates that the camshaft design of the prior art created valve bounce that steadily rose to 0.027" by 9,700 RPM. The range of common opinion is that engine limit speed is identified at the point where valve bounce exceeds 0.015" to 0.025". The camshaft based on the current invention controlled valve bounce up to 10,700 RPM, which is the current limit of the test rig, and it is expected that the current invention will control valve bounce to an even greater RPM. During this entire test, valve bounce was well below the threshold.

Figure 10:
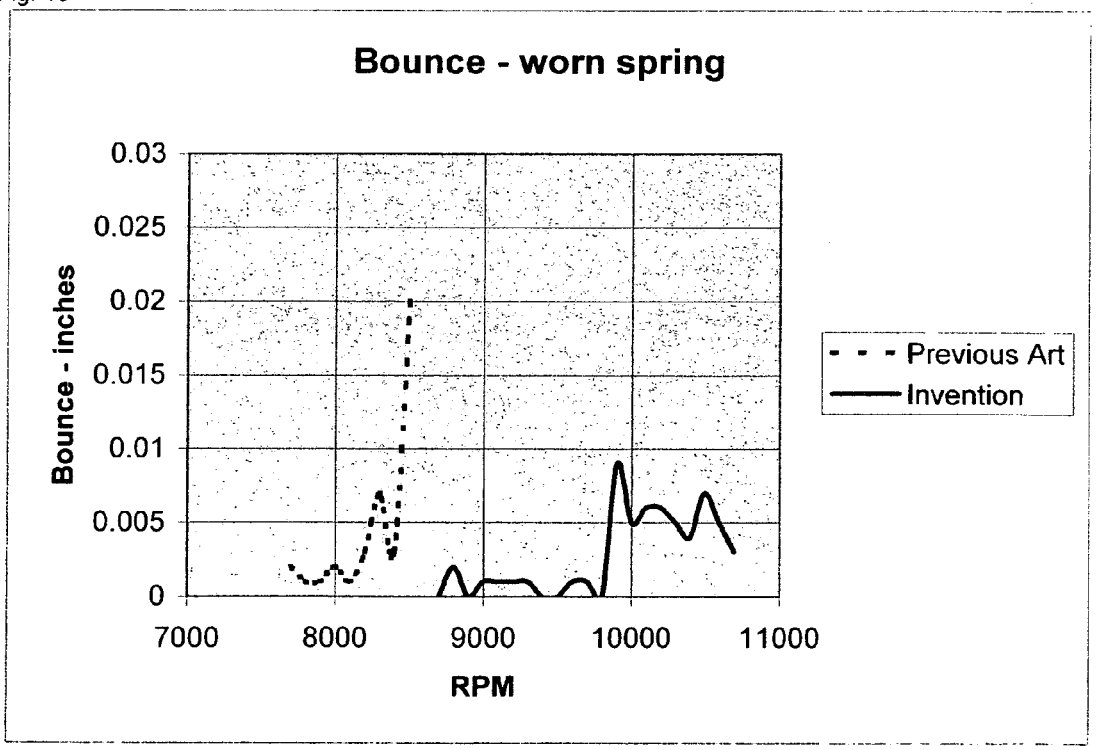
FIG. 10 is a graph comparing bounce of a worn valve spring with a conventional cam lobe versus a cam lobe of the present invention.

FIG. 10 shows two tests superimposed whereas a spring worn beyond service ability was installed at a seat pressure of 210#. This is condition that often occurs during the course (but before the end) of a race. That is, the engine starts the race with new valve springs, as represented in FIG. 9, but before the race is over, the valve springs have worn and deteriorated to the level shown in FIG. 10. The camshaft design of the prior art limited the engine's useful operating speed to 8,500 RPM when the valve springs had worn to this level or 1,200 RPMs less than when this spring was installed new. The camshaft based on the current invention still controlled valve bounce up to 10,700 RPM. Because of this insensitivity to normal spring deterioration, a camshaft based on the current invention could allow an engine to finish a race at a higher power output level than would be possible with the conventional cam design, or finish a race that would be otherwise impossible with the conventional cam design. Other possible benefits of this are the employment of lighter valve springs, which add less moving mass to the system, further increasing RPM potential. Such lighter valve springs can also be made of thinner spring wire which inherently has less stress and can last longer in endurance conditions.

These limit speed increases of 1,000 and 2,200 RPMs based on a single development are unheard of in the industry. Typical increases gained from a single successful development are on the order of 100 to 200 RPMs.

Figure 11:
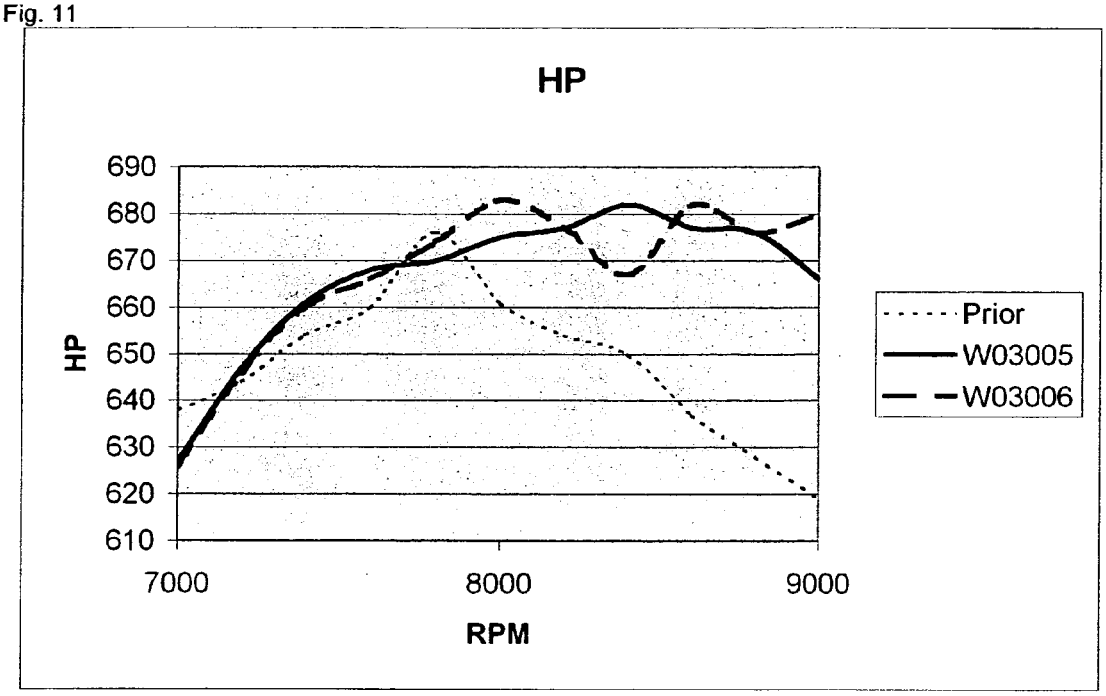
FIG. 11 is a graph comparing estimated horsepower of an engine using a conventional cam lobe versus two embodiments of a cam lobe of the present invention.
Figure 12:
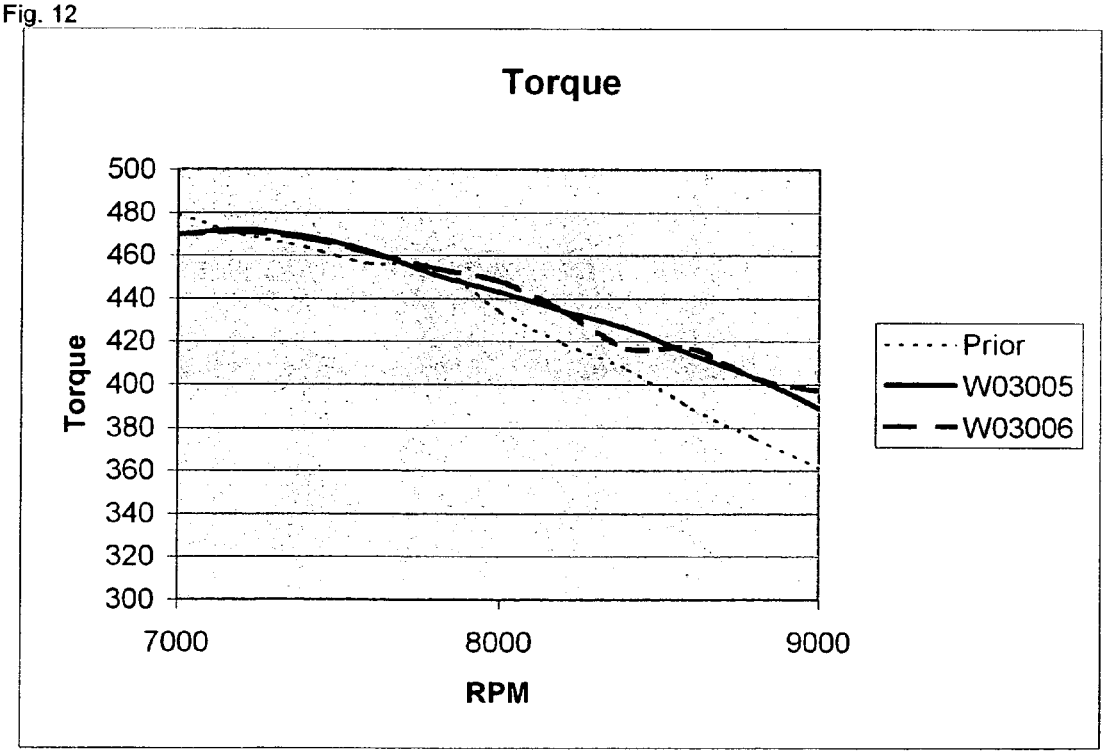
FIG. 12 is a graph comparing estimated torque of an engine using a conventional cam lobe versus two embodiments of a cam lobe of the present invention.

Further testing was done in the form of computer simulations of racing engines employing both prior art camshafts and camshafts using the current invention. Results are shown in FIGS. 11 and 12. Computer simulations expect that by changing nothing but the camshaft to that as designed by this current invention, gains of 40 or 50 HP in some speed ranges are possible. These levels of horsepower gains are extreme compared to normal gains in the industry.

It can be seen that the computer simulations also indicate that the engines powered by camshafts of the current invention have the potential to make power at higher RPMs. The exploitation of this phenomenon coupled with the valve train's proven ability to operate at much higher RPMs can translate into power gains that are quite significant.

It is noted that the characteristics and effects of the invention described herein will likely not be effective across a particular engine's entire operating speed range but are directed toward being effective at the upper portion of the engine's operating range. This, for instance, may be in the range of 8,000 RPM, or more, for a racing engine or engine of very high performance or may be in a range of 5,000 RPM for a street engine. Thus, the cam lobe design of the present invention will likely operate differently at 4,000 RPM in an engine having a maximum RPM of 10,000 RPM, than at the upper end of the operating range where the cam lobe design of the present invention is intended to operate best. The cam lobe shape can be adjusted/modified to give the described effects for a particular engine application and operating range.

The use of valve gear herein is intended to encompass any and all of the components used for actuating the valve, including the valve itself, but excluding the camshaft and cam lobe. Thus, if the cam lobe is in direct contact with the valve, the term valve gear would include the valve. If there are actuating components between the cam lobe and the valve, such as a rocker arm, term valve gear would also include the rocker arm that contacts both the cam lobe and the valve.

The present invention is also applicable to mechanisms other than internal combustion engines that utilize high speed camshaft systems, such as, for example and without limitation, an air pump.

It is intended that various of the features described above can be used in valvetrains in different combinations to create new embodiments.

What is claimed is:

1. A camshaft for a high speed spring-biased camshaft system, comprising:

a cam lobe for actuating a valve, the cam lobe having an opening ramp profile that acts to loft the valve gear away from contact with the cam lobe to a maximum lift of the valve, the valve gear returning to contact with a closing ramp of the cam lobe sufficiently in advance of a minimum cam lobe closing ramp height so as to dissipate enough closing energy of the valve to minimize valve bounce after the valve contacts a corresponding valve seat.

2. A camshaft as in claim 1, wherein the cam lobe has a profile that actuates the valve to have a maximum lift that is advanced toward the opening ramp of the cam lobe at least about 3° camshaft from a center of a total event of the cam lobe.

3. A camshaft as in claim 2, wherein the maximum lift of the valve is advanced by 3-12° camshaft.

4. A camshaft as in claim 3, wherein the maximum lift of the valve is advanced by 3-12° camshaft.

5. A camshaft as in claim 1, wherein the cam lobe has a profile having a positive velocity period at least about 6° camshaft shorter than a negative velocity period of the profile.

6. A camshaft as in claim 5, wherein the cam lobe profile has a positive velocity period of 6-24° camshaft shorter than the negative velocity period.

7. A camshaft as in claim 6, wherein the cam lobe profile has a positive velocity period of 12-18° camshaft shorter than the negative velocity period.

8. A camshaft as in claim 1, wherein an absolute value of the positive velocity of the cam lobe profile is greater than an absolute value of the negative velocity of the cam lobe profile by greater than 10%.

9. A camshaft as in claim 8, wherein the absolute value of the positive velocity of the cam lobe profile is greater than the absolute value of the negative velocity of the cam lobe profile by 10-40%.

10. A camshaft as in claim 9, wherein the absolute value of the positive velocity of the cam lobe profile is greater than the absolute value of the negative velocity of the cam lobe profile by 20-40%.

11. A camshaft as in claim 1, wherein the cam lobe has a profile that actuates the valve to have a minimum acceleration in advance of the maximum valve lift.

12. A camshaft as in claim 11, wherein the cam lobe has a profile that actuates the valve to have a minimum acceleration at least 3° camshaft in advance of the maximum valve lift.

13. A camshaft as in claim 12, wherein the minimum acceleration is 3-21° camshaft in advance of the maximum valve lift.

14. A camshaft as in claim 13, wherein the minimum acceleration is 9-21° camshaft in advance of the maximum valve lift.

15. A camshaft as in claim 1, wherein the cam lobe has a profile having a peak positive opening ramp acceleration greater than a peak positive closing ramp acceleration by greater than about 5%.

16. A camshaft as in claim 15, wherein the peak positive opening ramp acceleration is greater than the peak positive closing ramp acceleration by 5-40%.

17. A camshaft as in claim 16, wherein the peak positive opening ramp acceleration is greater than the peak positive closing ramp acceleration by 10-20%.

18. A camshaft as in claim 1, wherein the cam lobe has a profile having a peak negative opening ramp acceleration less than a peak negative closing ramp acceleration by greater than about 5%.

19. A camshaft as in claim 18, wherein the peak negative opening ramp acceleration is less than the peak negative closing ramp acceleration by 5-40%.

20. A camshaft as in claim 19, wherein the peak negative opening ramp acceleration is less than the peak negative closing ramp acceleration by 10-20%.

21. A camshaft as in claim 1, wherein the cam lobe has a profile that lofts the valve gear off of the cam lobe and the valve gear returns in contact with a closing ramp of the cam lobe at least 10% above a minimum cam lobe height.

22. A camshaft as in claim 21, wherein the valve gear returns in contact with the closing ramp of the cam lobe 10-40% above a minimum cam lobe height.

23. A camshaft as in claim 22, wherein the valve gear returns in contact with the closing ramp of the cam lobe 10-20% above a minimum cam lobe height.

24. A camshaft as in claim 1, for use in an internal combustion engine.

25. A mechanism incorporating a camshaft as in claim 1.

* * * * *